United States Patent [19]

Bristow et al.

[11] 4,391,569

[45] Jul. 5, 1983

[54] POSITIVE DISPLACEMENT PUMP SYSTEMS

[75] Inventors: Ian T. Bristow, Higham; Alec Thornelow, Chatham, both of England

[73] Assignee: Hobourn-Eaton Limited, Rochester, England

[21] Appl. No.: 101,791

[22] Filed: Dec. 10, 1979

[30] Foreign Application Priority Data

Dec. 13, 1978 [GB] United Kingdom ..... 48271/78

[51] Int. Cl.[3] ..... F04B 47/00

[52] U.S. Cl. ..... 417/302; 417/308

[58] Field of Search ..... 417/300, 302, 303, 304, 417/308

[56] References Cited

U.S. PATENT DOCUMENTS 2,996,013 8/1961 Thompson et al. ..... 417/304 X 4,021,155 5/1977 Erikson et al. ..... 417/304

*Primary Examiner*—Richard E. Gluck

*Attorney, Agent, or Firm*—Wenderoth, Lind & Ponack

[57] ABSTRACT

To minimize the power absorbed by a positive displacement pump system used where the requirement for pressure fluid varies inversely with the pump speed, notably in automobiles, the system provides two separate delivery passages 61, 62 for the pumped fluid and a discharge passage 66 into which the fluid from the delivery passage is passed under the control of a valve means 70, 71, the valve means commencing to operate on one (62) of the two delivered flows at lower speeds to by-pass a proportion of said one flow to an overspill 79, while the fluid not bypassed is added to the flow from the other delivery passage being passed to the discharge passage. The said proportion is increased in a manner to maintain the pressure drop across a discharge orifice in the discharge passage 66 at a constant value, and as the pump speed increases further the valve means commences to by-pass also an increasing proportion of the flow from said other delivery passage 61 to the overspill to maintain the said pressure drop constant. The increase in area of communication between the second delivery passage and overspill is greater than the increase in area of communication between the first delivery passage and overspill. In this way, the final regulation is carried out on a smaller quantity of fluid and less fluid is pumped to the highest pressure in the system.

21 Claims, 5 Drawing Figures

POSITIVE DISPLACEMENT PUMP SYSTEMS

Figure 1:
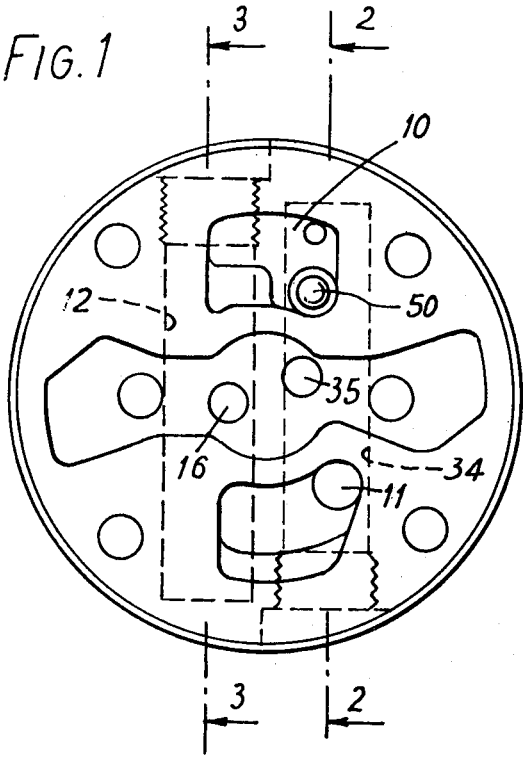

This invention relates to positive displacement pump systems equipped with valve means for controlling the delivery of the pump. Such valve means may for example control the quantity of liquid pumped to an external circuit substantially constant whatever the pump speed, or may maintain the pressure in an external circuit up to a predetermined maximum pressure. A pump system incorporating the former type of valve means has an important but not exclusive application in power-assisted steering arrangements for motor vehicles.

According to this invention there is provided a positive displacement pump system having first and second delivery passages for first and second flows of pumped fluid respectively, a main discharge passage for pumped fluid, overspill ducting, and valve means comprising a control valve controlling the apportionment of the first flow between the main discharge passage and the overspill ducting as a function of the delivery pressure of the first flow in a sense to increase the proportion of the first flow by-passed to the overspill ducting as said pressure increases and to decrease the proportion of the first flow by-passed to the overspill ducting as said pressure decreases, a transfer passage through which fluid can flow from the second delivery passage to join the first flow, and a transfer valve controlling, as a function of the delivery pressure of the first flow, the apportionment of the second flow between the overspill ducting and said transfer passage the proportion of the second flow by-passed to the overspill ducting increasing with increase of the delivery pressure of the first flow and decreasing with decrease of the delivery pressure of the first flow.

The control valve and the transfer valve may each comprise a valve member rotatable relative to a plate so as to control ports to which the overspill ducting and the appropriate passage or passages through which the flow of fluid controlled by the valve passes. In the embodiment more particularly described hereinafter the control valve and the transfer valve are each however in the form of a slide member mounted in a bore to which the passage or passages and the overspill ducting open. In preferred arrangements the control valve member and the transfer valve member are constituted by different portions of a common movable member.

Said function of the delivery pressure of the first flow may be the delivery pressure itself or a pressure directly proportional to the delivery pressure, but particularly useful embodiments, for use in supplying servo fluid at a constant rate to opencentre servo valves of power-assisted steering arrangements, can be obtained by employing, as said function, the pressure drop across an orifice in the main discharge passage. The pressures upstream and downstream of the orifice can conveniently be applied directly on a valve member of the slide type to urge the valve member in opposite directions.

Figure 2:
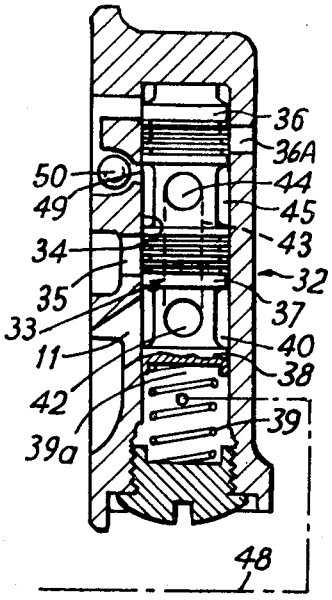
Figure 3:
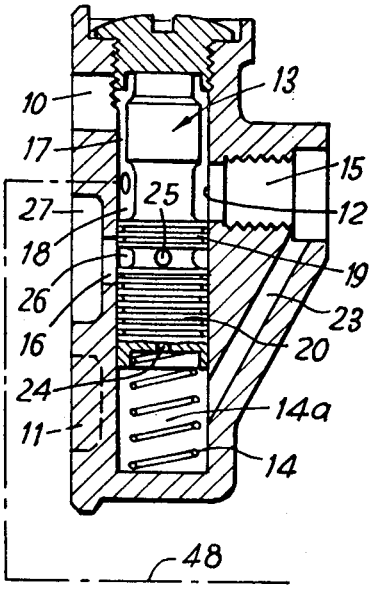
Figure 4:
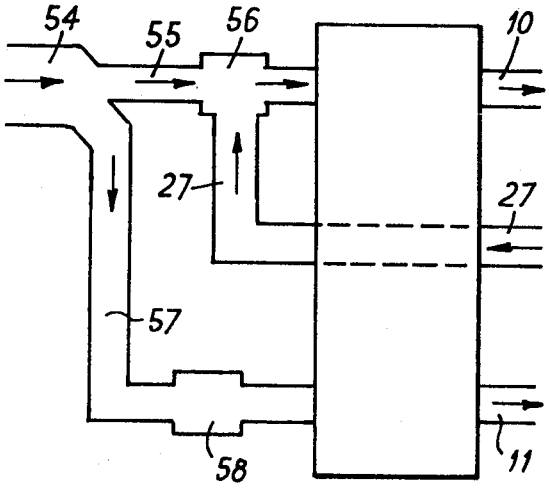
Figure 5:
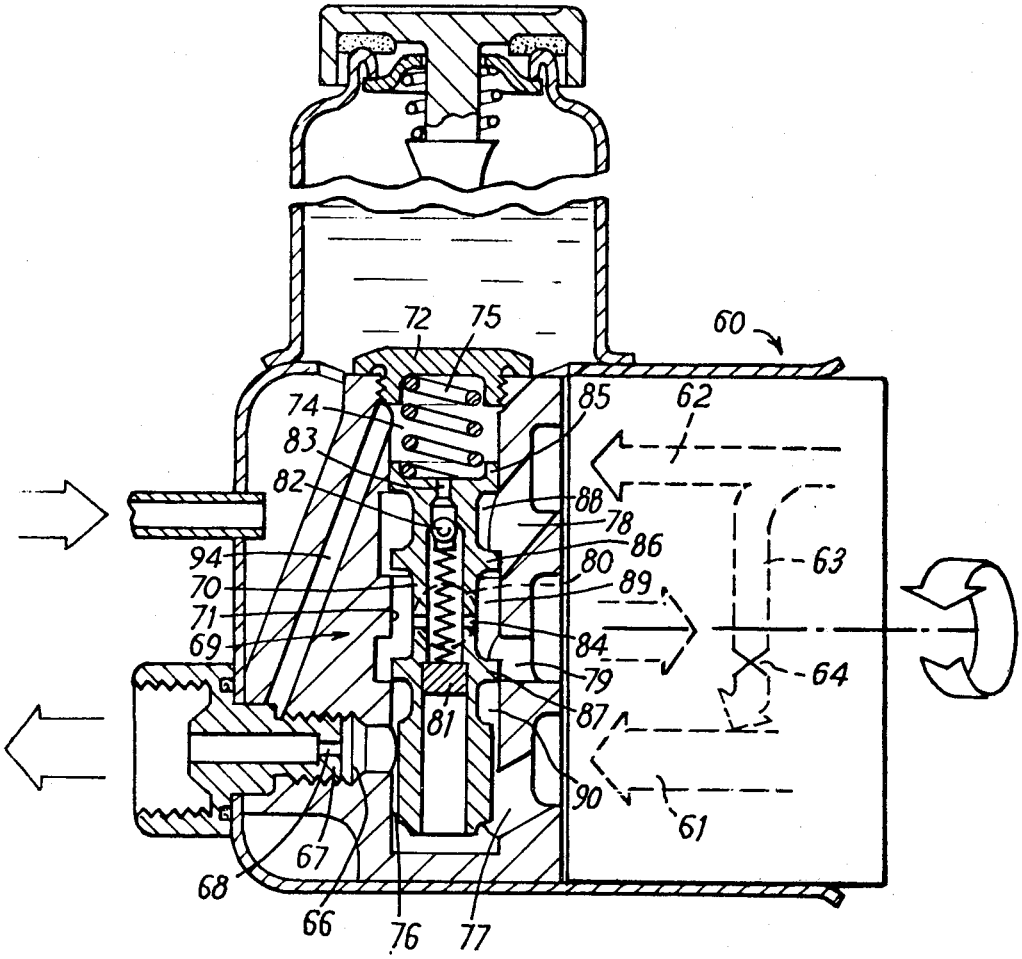

Some embodiments of the invention will now be described by way of example. The description makes reference to the accompanying diagrammatic drawings in which:

FIG. 1 shows the ported face of an end member of a pump system embodying the invention, FIGS. 2 and 3 are respectively sectional views on the plane 2—2 and 3—3 of FIG. 1, FIG. 4 is a diagram of a preferred inlet passage system for use in pump systems according to the invention, and FIG. 5 is a diagrammatic sectional elevation of the end member of a preferred system according to the invention.

The invention is applicable to any type of positive displacement pump system which has at least two outlet ports which are respectively supplied with fluid from separate pump chambers, but is particularly advantageous in pumps in which it is possible to arrange that a greater amount of fluid can be delivered to one of the ports than to the other. One such pump is the vane pump comprising an axially central generally annular member of which the radially inner surface is a cam profile and is engaged by vanes carried in respective generally radially extending slots in the periphery of a rotor which is secured to one end of a driving shaft, and end members secured to axially opposite sides of the central member. One of the end members provides a bearing for supporting the driving shaft and affords also an inlet passage leading by way of two branch passages to two inlet ports opening to the face of the end member adjacent the central member. The cam profile is such as to cause each vane to move radially inward and outward twice in each revolution of the rotor so that each vane performs two pumping cycles in each revolution. By shaping the cam profile so that one of the radial inward and outward movements is greater than the other, one of the pumping cycles can be caused to produce a greater delivery than the other. Two delivery passages receiving the pumped fluid from the two inlet ports respectively lead to respective delivery ports formed in the other end member and are in communication with each other under the control of a valve means interconnecting the outlet ports, a main outlet passage for the pumped fluid, and overspill porting. A pump of this type is described and shown in our British Patent Specification No. 818,644.

When the pump is used to provide a flow of servo fluid for power assisted steering in a motor vehicle, the requirement for a high pressure output occurs chiefly when the vehicle is being parked or is turning sharp corners, for both of which maneuvers the vehicle speed and engine speed are normally relatively low. The output of the pump is greatest when the vehicle is travelling at high speed, at which time large movements of the steering wheel are not made and would indeed be dangerous. Because of these conflicting requirements for a high output at low speed and low output at high speed, it is usual to provide a valve means which, when the pump delivery is in excess of the requirements of the servo system, by-passes a proportion of the pumped fluid back either to the servo fluid reservoir or to the pump inlet passage.

Referring now to FIGS. 1 to 3 of the accompanying drawings the end member of the casing of a first pump embodying the invention is shown, which casing provides the two delivery ports for the pumped fluid. These ports are shown at 10 and 11 and will be referred to as the first and second delivery ports respectively.

The delivery port 10 opens to one end of a control valve bore 12 (see FIG. 3) in which a control valve member 13 is slidably mounted. The member 13 is urged towards the said one end of the bore by a compression spring 14 in a spring chamber 14*a*. Also opening to the bore 12 are the main outlet passage 15 for the pumped fluid and an overspill port 16. In flowing from the first delivery port 10 to the main outlet passage 15, the fluid passes through an annular restricted passage 17 between the valve member and the wall of the bore, into an annular chamber 18 about the valve member and thence into the outlet passage. The valve member has two lands 19, 20 which close off communication between chamber 18 and the spring chamber 14*a* respectively and the overspill port 16. A constant-flow control orifice (not shown) is disposed in the outlet passage 15 and a pressure-sensing passage 23 extends from the downstream side of this orifice to the spring chamber 14*a*. An axial passage 24 extends through the valve member from the spring chamber to a cross-bore 25 opening to an annular space 26 which is formed between lands 19 and 20 of the valve member and which is in permanently open communication with the overspill port 16. The passage 24 contains a pilot relief valve (not shown) which operates to relieve excessive pressure in the pump, resulting for example from excessive resistance to steering. This excessive resistance tends to produce a high pressure at the downstream side of the control orifice and hence in the spring chamber 14*a*. If the pressure in the spring chamber exceeds its maximum permissible safe value, the fluid pressure opens the relief valve, permitting fluid to escape from the spring chamber through cross-bore 25 to the overspill port. The resulting fall in the pressure in the spring chamber causes the valve member 13 to move so as to increase the area of communication between chamber 18 and overspill port 16 so that an increased amount of fluid from delivery port 10 is diverted from the outlet passage 15 to the overspill port, so as to prevent the maximum safe pressure in the spring chamber from being exceeded. The overspill port leads to a recess 27 which may communicate with the main inlet passage in the other end member of the pump, e.g. by way of an axial passage extending along the pump shaft, or with the reservoir.

The ports 10 and 11 are in communication with each other only through a transfer valve 32, see FIG. 2.

The transfer valve comprises a valve member 33 slidably mounted in a valve bore 34 which is closed at both ends and which is parallel to the control valve bore 12. The valve bore 34 has an overspill port 35 which leads to the recess 27.

The transfer valve member has three lands 36, 37, 38 and is loaded by a spring 39 in a chamber 39*a* into abutment with the end of the valve bore adjacent the first delivery port 10. Between lands 36 and 37, the valve member has a cross-bore 44, and between lands 37 and 38 has a cross-bore 42, the two cross-bores being connected together by an axial bore 43.

In the initial or rest position of the transfer valve, land 36 is disposed adjacent the first delivery port 10 but permits pumped fluid from the second delivery port 11 to flow by way of an annular space 40 between lands 37, 38, cross-bore 42, axial bore 43 and cross-bore 44 in the valve member, an annular space 45 between lands 36 and 37, and a gap indicated at 49 between land 36 and the edge of port 10, to the first delivery port 10. The overspill port 35 is blanked off by land 37.

At low pump speed this flow from the second delivery port 11 thus joins the fluid delivered directly to the port 10 by the vanes and the combined flow moves along the restricted annular passage 17 to chamber 18 and thence to the outlet passage 15.

A passage indicated by a chain line 48 in FIGS. 2 and 3 extends from the chamber 18 to the spring chamber 39*a*.

The operation of the valve is as follows:

At low pump speeds the spring 39 holds the transfer valve member in the position shown in FIG. 2, so that all the pressure fluid from the secondary delivery port 11 flows through the cross-bore 42, axial passage 43, cross-bore 44 and annular space 45 to the delivery port 10, and thence through the restricted passage 17 and chamber 18 to the main outlet passage 15.

As the pump speed increases, the flow past the restriction 17 increases and causes an increasing pressure difference between port 10 and chamber 18. Passage 48 extending from chamber 18 to the spring chamber 39*a* of the transfer valve operates as a pressure sensing passage, so that the pressure in chamber 18 is applied in chamber 39*a* whilst the pressure at port 10 is applied to the adjacent end of valve member 33. The increasing pressure difference causes the transfer valve member 33 to move to reduce the size of the gap 49 between the land 36 and the edge of the port 10 and subsequently to commence to open communication between the annular passage 45 and the overspill port 35, so that the flow from port 11 is apportioned between port 10 and the overspill port.

As the pump speed continues to rise, the increased flow through the restricted annular passage 17 produces a further increasing pressure difference between port 10 and chambers 18 and 39*a*, and the resulting movement of the transfer valve member 33 against the spring 39 is arranged to cause the hydraulic forces on the valve member to be such that it moves rapidly to increase the area of communication between the annular space 45 and the overspill port 35 while reducing the area of the gap 49. The effect of this is to reduce the speed range over which the pressure in the second delivery port 11 is greater than that in the first delivery port 10.

The increasing flow through the discharge orifice in the outlet passage 15 produces a lowering of pressure at the downstream side of the orifice, and this lower pressure is transmitted via the passage 23 to the spring chamber 14*a*. When the resulting pressure difference acting on the control valve member 13 rises sufficiently to overcome the force of the spring 14 holding the flow control valve in its closed position, the member will move and land 19 will commence to uncover the overspill port 16 and a proportion of the flow will thus be returned to the pump inlet passage or the reservoir as previously described.

In order to avoid a continuously increasing pressure drop through the restricted passage 17, a hole 36A in the bore of the transfer valve becomes partly uncovered by the land 36 and serves to return a proportion of the flow to the reservoir or to the pump inlet passage. Thus the amount of fluid flowing through the restricted passage 17 is also controlled.

Continuing increase of the pump speed increases the delivery by the pump to the first delivery port 10 to such an extent that the delivery to the second delivery port 11 becomes unnecessary, and it is arranged that the land 36 closes the gap 49 and that the effective area of communication between the annular space 45 and the overspill port 35 is so large that the pressure of the fluid in the delivery port 11 is very low, and consequently the power absorbed by the pump now increases at a lesser rate than before with increasing pump speed.

It is preferred to incorporate a non-return valve 50 in a branch of port 10 in the transfer valve member leading to gap 49 to avoid any reversal of flow from port 10 through the gap 49 to the overspill port 35, such as may occur when the pump is running at low speed and is required to produce fluid at high pressure.

The restriction of passage 17 may be replaced by a restriction in the part of the first delivery port 10 which communicates with the control valve bore.

In another alternative design the pressure drop across the discharge orifice in the main outlet passage can be used instead of the pressure drop through the restricted passage 17. In this case the preloading of the spring 39 is adjusted so as to control the flow from the pump until the quantity of fluid delivered by the pump directly into the first delivery port 10 is sufficient to allow the fluid delivered by the pump to the delivery port 11 to be passed in its entirety through the overspill port 35.

As illustrated diagrammatically in FIG. 4, the main intake passage 54 is preferably branched into a duct 55 leading to a first chamber 56 whence the fluid is pumped by the pump to the first delivery port 10, and another duct 57 leading to a second inlet chamber 58 whence the fluid is delivered by the pump to the second delivery port 11, and all the fluid from the overspill recess 27 is discharged into the said first chamber 56. In this way the intake 55 to the section of the pump from which fluid is pumped to the first delivery port 10 is supercharged so as to improve the performance of the pump at high speed and prevent the onset of cavitation in this section of the pump.

Referring now to FIG. 5 of the drawings, a preferred pump according to the invention is illustrated in which the transfer valve and control valve of FIGS. 1 to 3 are combined, but the mode of operation is similar. The pump, shown diagrammatically at 60, is required to deliver pressure fluid to first and second delivery passages 61, 62 which are in communication with each other through a connecting passage 63 in the pump casing, and passage 63 contains a non-return valve, indicated at 64, which permits flow from passage 62 to passage 61 but not in the reverse direction. The combined flow from passages 61 and 62, less any which is surplus to the immediate requirements of the external circuit and which is directed to an overspill port 79 in the valve and thence to a fluid reservoir or the pump inlet for recirculation, is delivered to the external circuit through a main discharge passage 66 in which is mounted a threaded plug 67 providing a discharge control orifice 68. The orifice is of accurately predetermined diameter according to the required fluid delivery, and the pressure drop across the orifice is applied to the combined valve 69 for the purpose of maintaining the flow through the orifice substantially constant.

The valve 69 comprises a valve member 70 slidably mounted in a valve bore 71. The upper end of the valve bore has screwed into it a sealing plug 72 forming a chamber 74 at the upper end of the bore. Chamber 74 contains a spring 75 which urges the valve member 70 downward into abutment with the other end of the valve bore.

A continuation of the second delivery passage 62 beyond passage 63 communicates with the valve bore through a port 78. The combined flow from passages 61 and 63 flows into the lower end of the valve bore through a port 77 and thence through an annular restriction 76 between the wall of the valve bore and a reduced-diameter end portion of the valve member into the discharge passage 66. Between the port 78 and 77, an overspill part 79 and an auxiliary overspill port 80 lead off the valve bore to the inlet passage system of the pump.

An axial bore extending along the valve member 70 contains a sealing plug 81 which serves as a base for a spring of a pilot relief valve 82 for relieving excess pressure in the spring chamber 74 via an axial hole 83, radial holes 84 and the overspill ports 79, 80.

The external surface of the valve member has three axially-spaced annular lands 85, 86, 87 forming between them annular chambers 88, 89. A third annular chamber 90 extends about the valve member between the land 87 and the reduced diameter lower end portion of the valve member. Ports 79 and 80 together ensure that the annular chamber 89 is in communication with the overspill passage in all positions of the valve member.

Land 85 blanks off the spring chamber 74 from the port 78 in all positions of the valve member.

The valve member is shown displaced from its initial position at the lower end of the valve bore. In the initial position of the valve member, when the pump is operating at low speed, lands 86 and 87 blank off communication between port 78 and annular chamber 90 respectively and annular chamber 89, and in consequence the full flow from the second delivery passage 62 flows through passage 63 to join the flow through the first delivery passage 61. The combined flow passes through the annular restriction 76 and thence through the discharge orifice 68 to the external circuit.

The pressure at the downstream side of the discharge orifice 68 is applied to the upper end face of the valve member in the spring chamber 74 through a passage 94. The pressure of the fluid acting against the lower end face of the valve member is augmented by the pressure at the upstream side of the orifice applied, in chamber 90, to an annular area of the valve member equal to the area of the restriction 76 in a section plane at right angles to the axial dimension of the valve member. The force applied to the valve member against the force of spring 75 is increased by the presence of the restriction 76, which causes a pressure slightly higher than the pressure in chamber 90 to be applied to the lower end face of the valve member. As the pump speed increases, the pressure drop across the orifice 68 also increases and when the pump delivery increases to a predetermined value the resultant force on the valve member overcomes the spring force and raises the valve member causing the land 86 to open communication between port 78 and chamber 89, enabling some of the fluid from the second delivery passage 62 to flow through the overspill ports 79, 80 so as to reduce the flow through the connecting passage 63. As the pump speed continues to increase, the increasing pressure drops across restriction 76 and discharge orifice 68 cause the valve member to be lifted higher, and since the pressure drop across the restriction 76 increases according to substantially a square law the higher force applied in raising the valve member assists in overcoming Bernoulli forces, which resist the opening of cummunication between chambers 90 and 89. The raising of the valve member opening communication between chambers 90 and 89 permits some of the flow issuing through port 77 to pass to the overspill. To pass a given amount of excess fluid from chamber 90 to overspill port 79 a certain axial movement of the valve member is necessary. This axial movement increases the area of opening between land 86 and the adjacent co-operating edge in the valve bore by a greater amount than that by which the area of communication between chamber 90 and port 79 is increased. As the amount of fluid to be passed through this area between land 86 and the co-operating edge in the valve bore does not rise by the same proportion, with increasing pump speed the axial displacement of the valve member reaches a value at which the fluid pressure in port 78 falls below that in port 77, and at this stage the non-return valve 64 closes. As the pump speed increases further the flow control is exercised by land 87 on the flow from the first delivery passage 61, while the proportionately greater increase in area of opening between land 86 and the adjacent co-operating edge in the valve bore causes a substantial reduction in the pressure in the second delivery passage 62. At this stage, the cycle of the pump which is delivering fluid to the second delivery passage 62 is absorbing much less energy than if all the delivered fluid flowed through port 77 and the control were exercised by land 87.

It will be appreciated that the control on flow from port 78 to the overspill port exercised by land 86 and the adjacent co-operating edge in the valve bore could be exercised alternatively by axial grooving in the valve member.

If the pressure at the downstream side of the discharge orifice 68 exceeds a predetermined maximum safe value, the pilot relief valve opens and allows fluid from the spring chamber to flow into the annular chamber 89 and thence to overspill. The resulting drop in the pressure in chamber 74 causes a corresponding upward movement of the valve member and increases the amount of fluid flowing to overspill from the delivery passages and thus operates to leave the pressure at the downstream side of the discharge orifice at a safe value.

The arrangement described in relation to FIG. 4 can advantageously be applied to the pump shown in FIG. 5.

In some constructions intended for use other than in power-assisted steering it may be desirable to design the system so that fluid from the first delivery passage commences to pass to the overspill ports before fluid from the second delivery passage. Nevertheless, even in these arrangements, the fact that the rate of increase of area of communication between passage 62 and the overspill ports is greater than that of passage 61 leads to a greater fall in pressure in the passage 62 than in passage 61 over the normal range of movement of the valve member.

Where the pump is of a design in which the pressures in the two delivery ducts act in diametrically opposite directions on the pump rotor, the passing of the entire delivery from the second delivery passage to overspill at low pressure tends to unbalance the pump, and the unbalance may become acute at high pump speeds and may adversely affect the pump bearings if the delivery pressure is high. This problem can be alleviated to a substantial extent in the arrangement of FIG. 5 by replacing the nonreturn valve 64 by an orifice which restricts the flow between the first and second delivery passages to some extent. At low pump speeds, such a pump system operates in the same way as described above in relation to FIG. 5, but when the pump speed increases to a value such that the fluid in the second delivery passage is being discharged to overspill at a lower pressure than obtains in the first delivery passage, the flow through the orifice is reversed so as to bleed a quantity of fluid from the first delivery passage to the overspill by way of the second delivery passage and to reduce the pressure in the first delivery passage at the higher pump speeds. The amount of fluid passing through the main discharge passage is still controlled by the valve in dependence on the pressure drop across the orifice 68, and the valve is thus still automatically adjusted to deliver the same constant flow of fluid to the discharge passage. There is however a more progressive relief of the pressure in the first delivery passage with increase in pump speed.

In view of the saving of energy which results, at high pump speeds, from passing to overspill the whole of the delivery of the pump to the second delivery passage, it is advantageous in some cases to arrange for the pump to deliver a greater quantity of fluid to passage 62 than to passage 61, so that at high speeds there is a correspondingly increased energy saving.

The pump shown in the drawings has numerous advantages, and permits other advantages to be obtained by appropriate design according to the purpose for which the pump is required, as follows:

(1) Since at high pump speeds the whole of the flow delivered to the second delivery passage is by-passed from the external circuit and is directed at low pressure into the overspill, substantial energy is saved at these higher pump speeds; furthermore, since this overspill liquid is not pumped to a high pressure its temperature remains at a lower value, which is advantageous in itself because it leads to a lower mean temperature of the body of working fluid in the pump system, but which leads to the further advantage that leakage from the pump is reduced, enabling a smaller pump to be used, and this in turn leads potentially to a saving in manufacturing costs and to a further saving of energy.

(2) Since the whole of the flow from one of the two delivery passages is, at high pump speeds, by-passed from the extenal circuit and passed on to an overspill passage, it can be advantageous to use a pump in which unequal quantities of pumped fluid are delivered to the two delivery passages, and in some important applications of the pump the second delivery passage may have the larger quantity of fluid pumped into it, with consequent increased energy saving at higher pump speeds.

(3) The amount of fluid fed to the final flow control section of the valve is much smaller, enabling improved regulation by the valve to be obtained.

(4) It is possible to obtain, plotting pump speed against delivery into the main discharge passage, a flat or falling characteristic, that is to say a characteristic in which the flow into the main discharge passage, having reached a maximum value at a given pump speed is maintained constant or decreases as the pump speed increases.

(5) Where, as in the case of a pump for power-assisted steering, the requirements is for a constant flow in the external circuit, additional pressure is created in the pump delivery for the purpose of moving the valve member to achieve the required control. This additional pressure inevitably introduces losses, but in the present constructions these losses are reduced because a lesser quantity of fluid is pumped to these pressures.

(6) By supplying fluid from the overspill to the pump inlet ports associated with the first delivery passage, improved filling of the pumping chambers in the relevant cycle is improved, and since that reduces the amount of noise emitted from the pump at high speed, the pump can run at higher speeds for a given permissible noise level.

(7) In an arrangement in which the pump is designed to deliver less fluid to the first delivery passage than to the second delivery passage, the former cycle of the pump can operate more satisfactorily at high speed since the amount of fluid to be drawn into the pumping chambers is then less, and since the pump can thus run at a higher speed, a smaller pump can be used.

We claim:

1. A positive displacement pump system having first and second delivery passages for first and second flows of pumped fluid respectively, a main discharge passage for pumped fluid, overspill ducting, and valve means comprising a control valve controlling the apportionment of the first flow between the main discharge passage and the overspill ducting as a function of the delivery pressure of the first flow in a sense to increase the proportion of the first flow by-passed to the overspill ducting as said pressure increases and to decrease the proportion of the first flow by-passed to the overspill ducting as said pressure decreases, a transfer passage through which fluid can flow from the second delivery passage to join the first flow, said value means further comprising a transfer valve controlling, as a function of the delivery pressure of the first flow, the apportionment of the second flow between the overspill ducting and said transfer passage, the proportion of the second flow by-passed to the overspill ducting increasing with increase of the delivery pressure of the first flow and decreasing with decrease of the delivery pressure of the first flow.

2. A pump system as claimed in claim 1, wherein the valve means comprises a piston valve member slidably mounted in a valve bore having lands and co-operating with said bore to carry out the functions of both the control valve and the transfer valve.

3. A pump system as claimed in claim 2, wherein the piston valve member is loaded in one axial direction by a spring disposed in a spring chamber, and wherein an entry port for the first fluid flow and a main outlet port open to the valve bore and are in permanently open communication with each other, a pressure of the fluid flowing through the said entry port being applied to the valve member in opposition to the force of the spring.

4. A pump system as claimed in claim 3, comprising a restrictor through which the fluid from the main outlet port is passed, and a duct extending between the downstream side of the restrictor and said spring chamber.

5. A pump system as claimed in claim 4, in which said second delivery passage has a continuation extending from said transfer passage and opening to said valve bore, and said overspill porting opening to the overspill ducting from a location in the valve bore axially spaced from the continuation, said piston valve member being axially movable against the spring force from an initial position in which the piston valve member blanks off communication between the continuation and the overspill porting into an off-loading position in which the piston valve member opens communication between the continuation and the overspill porting.

6. A pump system as claimed in claim 5, wherein the piston valve member has a portion which blanks off communication between the entry port for the first fluid flow and the overspill porting, and said pressure of the fluid which flows through the entry port urges the piston valve member in a direction progressively to move said portion to bring the entry port into communication with the overspill porting.

7. A pump system as claimed in claim 6, wherein the overspill porting is sized and disposed in co-operation with the piston valve member and the continuation to cause each movement of the piston valve member in opposition to the spring force, from commencement of communication between the entry port and the overspill porting, to increase the area of communication between the continuation and the overspill porting by a greater amount than that by which the area of communication between the entry port and the overspill porting is increased.

8. A pump system as claimed in claim 3, further comprising a spring-loaded relief valve for limiting the pressure in the spring chamber.

9. A pump system as claimed in claim 8, wherein the relief valve is mounted in a passage extending axially along the piston valve member, which passage is in permanently open communication with the overspill porting through a radial passage formed in the piston valve member.

10. A pump system as claimed in claim 1, said system including pump means having separate first and second intake ducts from which fluid is pumped into said first and second delivery passages respectively, said overspill ducting being connected to said first intake passage for delivering overspill fluid thereinto.

11. A pump system as claimed in claim 3, wherein a flow restrictor is provided through which the fluid passing through the entry port flows.

12. A pump system as claimed in claim 11, wherein the entry port and the main outlet port are axially spaced and the valve member and the valve bore together form said flow restrictor, said restrictor extending between the entry and main outlet ports, and the pressure at the upstream end of the flow restrictor being applied to an end of the valve member in opposition to the spring force.

13. A pump system as claimed in claim 1, wherein the piston valve and transfer valve comprise respective piston valve members mounted in respective bores and are loaded into an initial stop position by respective springs disposed in spring chambers in the respective bores.

14. A pump system as claimed in claim 13, wherein an entry port for the first fluid flow and a main outlet port open to the control valve bore, and said ports are in permanently open communication with each other, the pressure of the fluid flowing through the entry port being applied to the control valve member in opposition to the forst of its spring.

15. A pump system as claimed in claim 14, wherein a pressure transmission passage is provided for transmitting to the spring chamber of the transfer valve a pressure of the fluid flowing through the entry port in the control valve bore.

16. A pump system as claimed in claim 14, comprising a restrictor through which the fluid from the main outlet port is passed, and a duct extending between the downstream side of the restrictor and said spring chamber in the control valve bore.

17. A pump system as claimed in claim 16, wherein the second delivery passage and an outlet port leading to the first delivery passage open at axially spaced locations to the transfer valve bore and, in the initial position of the transfer valve member, are in communication with each other only through an axially extending passage in the valve member, and wherein the overspill porting opens to the transfer valve bore at an axial location between the second delivery passage and said outlet port leading to the first delivery passage, the transfer valve member having a land which permanently obstructs communication between the second delivery passage and the overspill porting except by way of said axial passage in the transfer valve member, said land obstructing communication between the outlet port and the overspill ducting in the initial position of the transfer valve member but opening communication as the transfer valve member is moved against the force of its spring.

18. A pump system as claimed in claim 17, wherein the control valve member has a portion which blanks off communication between the entry port for the first fluid flow and the overspill porting, and said pressure of the fluid which flows through the entry port urges the transfer valve member in a direction progressively to move said portion to bring the entry port into communication with the overspill porting.

19. A pump system as claimed in claim 18, wherein a spring-loaded relief valve is provided for limiting the pressure in the spring chamber of the control valve member.

20. A pump system as claimed in claim 19, wherein the relief valve is mounted in a passage extending axially along the control valve member, which passage is in permanently open communication with the overspill porting through a radial passage formed in the control valve member.

21. A pump system as claimed in claim 1, wherein an orifice is provided in the transfer passage for limiting flow of the fluid between the first and second delivery passages.

* * * * *